US006447105B1

(12) United States Patent
Reinten

(10) Patent No.: US 6,447,105 B1
(45) Date of Patent: Sep. 10, 2002

(54) INK-JET SYSTEM WITH AN INK CHANNEL HAVING A NON-UNIFORM DEPTH

(75) Inventor: Hans Reinten, Velden (NL)

(73) Assignee: Oce-Nederland B.V., Venlo (NL)

( * ) Notice: Subject to any disclaimer, the term of this patent is extended or adjusted under 35 U.S.C. 154(b) by 974 days.

(21) Appl. No.: 08/646,399

(22) Filed: May 9, 1996

(30) Foreign Application Priority Data

May 9, 1995 (EP) ..... 95201194

(51) Int. Cl.[7] ..... B41J 2/045
(52) U.S. Cl. ..... 347/70; 347/94
(58) Field of Search ..... 347/68, 70, 71, 347/65, 94

(56) References Cited

U.S. PATENT DOCUMENTS

| | | | | |
|---|---|---|---|---|
| 5,119,116 A | | 6/1992 | Yu | 347/65 |
| 5,502,468 A | * | 3/1996 | Knierim | 347/19 |

FOREIGN PATENT DOCUMENTS

| | | | | |
|---|---|---|---|---|
| EP | 67653 | * 12/1982 | | 347/71 |
| EP | 404172 | 2/1994 | | |
| JP | 5732975 | * 2/1982 | | |
| JP | 59162060 | * 9/1984 | | |
| JP | 608074 | * 1/1985 | | |
| JP | 61-279561 | 12/1986 | | |
| JP | 62134267 | * 6/1987 | | 347/68 |
| JP | 32041 | * 1/1991 | | 347/68 |
| JP | 3-81155 | * 4/1991 | | 347/94 |
| JP | 4263950 | 9/1992 | | |
| JP | 6064178 | 3/1994 | | |

* cited by examiner

*Primary Examiner*—Benjamin R. Fuller
*Assistant Examiner*—C Dickens
(74) *Attorney, Agent, or Firm*—Birch, Stewart, Kolasch & Birch, LLP

(57) ABSTRACT

An ink-jet system has an ink channel between an ink reservoir and a nozzle, and an electromechanical transducer which comprises an expansible member arranged adjacent to the ink channel for abruptly reducing the volume of the ink channel in order to eject an ink droplet through the nozzle. The depth of a portion of the ink channel between the expansible member and the nozzle is larger than both the depth of the portion adjacent to the expansible member and the height of the nozzle.

22 Claims, 1 Drawing Sheet

INK-JET SYSTEM WITH AN INK CHANNEL HAVING A NON-UNIFORM DEPTH

FIELD OF THE INVENTION

The invention relates to an ink-jet system comprising an ink channel between an ink reservoir and a nozzle, and an electromechanical transducer which comprises an expansible member arranged adjacent to the ink channel for abruptly reducing the volume of the same in order to eject an ink droplet through the nozzle. Such ink-jet systems are used as printheads in ink-jet printers.

DESCRIPTION OF THE INVENTION

A drop-on-demand ink-jet system of the type indicated above is known, for example, from EP-B1-0 402 172. In this known system, the ink channel is formed in a substrate which is sandwiched between a bottom plate and a cover plate such that the top and bottom surfaces of the ink channel are formed by the cover plate and the bottom plate, respectively. The ink channel has a constant depth which is identical to the height of the nozzle, but has a larger width than the nozzle and is tapered at its front end so that its width is gradually reduced to that of the nozzle. The expansible member of the electromechanical transducer is formed by a plate-like piezoelectric element which is disposed underneath the bottom plate within the area of the ink channel. The piezoelectric element is supported on a rigid support plate and has its top end face directly engaged with the bottom plate of the ink channel. When an electric voltage is applied to the piezoelectric element, the piezoelectric material expands in the vertical direction, and the elastic bottom plate is flexed inwardly of the ink channel, so that an ink droplet is expelled from the nozzle.

U.S. Pat. No. 5,119,116 discloses a thermal ink-jet system in which the ink channel is provided with a step structure such that the height of the nozzle is smaller than the depth of the main portion of the ink channel. The pressure required for expelling an ink droplet from the nozzle is formed by a bubble-generating heating element disposed in a pit which is formed in the bottom of the ink channel upstream of the step structure.

SUMMARY OF THE INVENTION

In a practical printhead for high-speed and high-resolution printing, a plurality of ink-jet systems are integrated on a common substrate. In order to achieve objectives like large-scale integration, a high maximum frequency of drop generation and the like, the ink-jet systems should be made as compact as possible. On the other hand, the ink-jet systems should be operable with moderate voltages and must nevertheless be capable of providing a sufficient energy for creating droplets of a suitable size and accelerating them to a suitable speed so that the droplets may be deposited on the recording medium with high accuracy.

It is therefore an object of the invention to improve the energy efficiency of the ink-jet system. According to the invention, this object is achieved with an ink-jet system in which the depth of a portion of the ink channel between the expansible member and the nozzle is larger than both the depth of the portion adjacent to the expansible member and the height of the nozzle.

It has been found that this construction provides a significant improvement in the efficiency with which the electric energy applied to the transducer is converted into kinetic energy of the droplet.

The total energy efficiency depends largely on the following two factors: (1) The efficiency with which the electric energy of the transducer is converted into energy of an acoustic wave propagating in the ink liquid and (2) the efficiency with which the acoustic energy is conferred to the droplet created at the nozzle.

The first factor is determined by the ratio between the depth of the ink channel and the thickness of the expansible member of the transducer, e.g. the piezoelectric element. Ideally, this ratio should be substantially equal to the ratio between the elastic modulus of the piezoelectric material and the ink liquid. Since the piezoelectric material generally has a comparatively large elastic module and, on the other hand, the thickness of this element is limited by practical constraints, this factor requires a rather small depth of the ink channel.

The second factor depends on the ratio between the sectional areas of the nozzle and the ink channel. Ideally, this ratio should be so selected that an optimal "impedance match" is provided for the acoustic wave, in order to avoid energy losses by reflection of the acoustic wave. Since the cross-section of the nozzle is determined by the desired size of the droplets and the width of the ink channel should not be made too large, a comparatively large depth of the ink channel would be desirable in view of this factor.

According to the invention, both factors are brought closer to the optimum by. selecting a rather small depth for the portion of the ink channel adjacent to the transducer and by increasing the depth of the portion of the channel adjacent to the nozzle in order to achieve a better impedance match. Computer simulations have shown that, in this way, the total energy efficiency can be increased in the order of a factor of ten.

In one embodiment, the depth of the portion of the ink channel between the transducer and the nozzle is gradually increased from the transducer towards the nozzle. Since, in this case, there are only smooth transitions in the depth of the channel upstream of the nozzle, energy losses due to reflections of the acoustic wave can be reduced.

It has been found however that it is not always necessary to avoid reflective structures in the ink channel upstream of the nozzle and that, in fact, such reflective structures may even be beneficial in terms of energy efficiency.

In another embodiment of the invention, the portion of the ink channel between the transducer and the nozzle is therefore designed as a cavity which causes partial reflection of acoustic waves at both the upstream and downstream ends thereof. In this case the cavity can serve as an energy accumulator which can trap or accumulate acoustic energy in order to provide maximum power at the moment at which a droplet is to be generated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
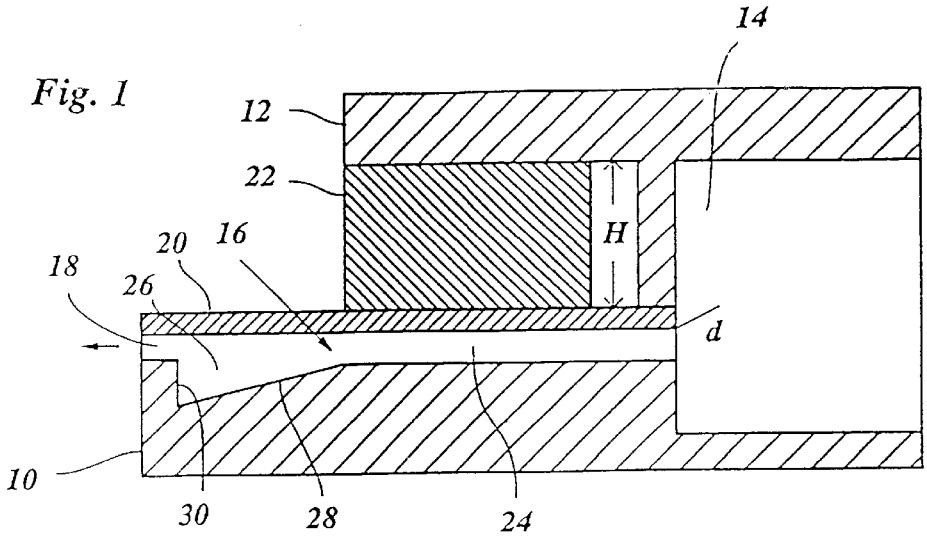
FIG. 1 is a schematic longitudinal section of an ink-jet system according to one embodiment of the present invention.

The ink-jet system shown in FIG. 1 comprises a substrate 10 and a support structure 12 with an ink reservoir 14 defined therebetween. An ink channel 16 connects the ink reservoir 14 to a nozzle 18 from which ink droplets are to be expelled. The ink channel 16 and the nozzle 18 are defined by a groove formed in the top surface of the substrates 10 and covered by an elastic cover plate 20. A plate-like piezoelectric element 22 is interposed between the support structure 12 and the cover plate 20 above an upstream portion 24 of the ink channel 16.

The ink channel has a horizontal width of, for example, 200 $\mu$m almost throughout its entire length, except for a tapered portion at the front end where the width is gradually reduced to the width of the nozzle 18 which has a square cross-section of, for example, 30×30 $\mu$m.

In the upstream portion 24 adjacent to the piezoelectric element 22, the ink channel has a constant depth of e.g. 50 $\mu$m. However, in a downstream portion 26 which is located between the downstream end of the piezoelectric element 22 and the nozzle 18, the depth of the ink channel is generally larger than in the upstream portion 24 and hence also larger than the height of the nozzle 18. In this downstream portion 26, the bottom surface of the ink channel forms a slope 28 which descends from the bottom surface of the upstream portion 24 to a step 30 at the upstream end of the nozzle 18. Thus, the depth of the downstream portion 26 of the ink channel gradually increases from 50 $\mu$m to approximately 170 $\mu$m at the step 30. Thus, the depth of the ink channel more than triples from the upstream portion 24 to the maximum downstream portion depth.

In the drawing the vertical dimensions are greatly exaggerated in comparison to the lengthwise dimensions. In a practical example, the piezoelectric element 22 has a height H of 500 mm and an axial length of about 7 mm.

In the shown embodiment the ink-jet system is a drop-on-demand system intended for use with hot melt ink. In operation, the ink is heated by a heating system (not shown) so that the ink reservoir 14 and the ink channel 16 are filled with molten ink. In the nozzle 18 the ink liquid is held by capillary forces so that it is prevented from leaking out of the mouth of the nozzle.

The piezoelectric element 22 is provided with electrodes (not shown) and is so polarized that it expands and shrinks in the vertical direction in FIG. 1 depending on whether or not a voltage is supplied to the electrodes. The piezoelectric element 22 is an expansible member of a transducer.

In the normal (rest) condition, the piezoelectric element 22 is expanded, so that the cover plate 20 is slightly bent downward and the volume of the upstream portion 24 of the ink channel 16 is reduced.

When an ink droplet is demanded, a pulse signal is applied to the electrodes of the piezoelectric element 22 so that it shrinks and ink from the reservoir 14 is sucked into the upstream portion 24 of the ink channel. Simultaneously, a negative pressure will act upon the volume of ink which is present in the downstream portion 26 of the ink channel and in the nozzle 18. As a result, the air/liquid meniscus in the nozzle 18 will slightly move inwardly. The length of the nozzle 18 is, however, so selected that the meniscus will not move beyond the step 30.

At the trailing edge of the pulse signal, the piezoelectric element 22 expands again, so that a positive pressure wave is generated in the adjacent portion 24 of the ink channel. This pressure wave propagates in both directions in the ink channel 16, i.e. towards the reservoir 14 and towards the nozzle 18. The wave front propagating in the direction of the nozzle 18 travels through the downstream portion 26 of the ink channel and is horizontally converged to the nozzle 18 by the taper (not shown) of the ink channel. As the depth of the ink channel varies only gradually in the portion 26, there will be no substantial energy losses due to reflection of the pressure wave before it reaches the step 30.

Since the cross-sectional area of the ink channel 16 is significantly reduced at the step 30 and the ink volume which is at rest within the nozzle 18 has a certain mass and viscosity, the step 30 behaves somewhat like a closed end of an acoustic waveguide. This closed end tends to cause reflection of the positive pressure wave without reversal of the sign thereof. Thus, a high pressure is built up at the step 30 due to superposition of the incoming wave with the reflected wave. Since on the other hand the pressure at the open mouth of the nozzle 18 is equal to zero, a high pressure gradient is generated across the length of the nozzle 18, and the liquid volume in this nozzle is efficiently accelerated so that it forms an ink droplet which is expelled in the direction indicated by an arrow in FIG. 1.

It should be noted that the wavelength of the acoustic wave generated by the electric pulse applied to the piezoelectric element 22 will be of the order of twice the length of this piezoelectric element and will accordingly be significantly larger than the axial length of the nozzle 18. Thus, the pressure at the step 30 will still be rising when the liquid in the nozzle 18 has already been accelerated to a considerable velocity. The rapid flow of the liquid in the nozzle 18 which is still being accelerated absorbs a great deal of the energy carried by the acoustic wave and tends to relieve the pressure at the step 30. A portion of the energy is dissipated due to the viscosity of the ink, and another portion is used for forming and further accelerating the ink droplet. As a result, the character of the step 30 changes from a closed end to that of an open end. The reflection of the trailing part of the high pressure wave at the step 30 therefore resembles a reflection at an open end, i.e., the high pressure wave is reflected as a low pressure wave, and the incoming and reflected waves will be superposed in a manner to minimize reflection losses at the step 30.

As a result of this mechanism, the reflection of the high pressure wave at the step 30 and the nozzle 18 is largely suppressed and a major part of the acoustic energy becomes available for the formation and acceleration of the ink droplet. The energy transfer to the droplet is optimized by properly adjusting the height of the step 30 dependent on the dimensions of the nozzle 18 and the viscosity of the ink.

In comparison, if the step 30 and the slope 28 were not present, the change in cross-section between the portion 26 of the ink channel and the nozzle 18 would be less significant and the nozzle 18 would behave more like an open end from the beginning, with the result that a considerable part of the acoustic energy would be reflected back towards the ink reservoir 14 rather than being transformed into kinetic energy of the droplet.

The effect of the step 30 as described above could of course also be achieved by giving the ink channel 16 a large depth of 200 μm on its entire length. This would have another drawback as will now be explained by reference to FIG. 2.

Figure 2:
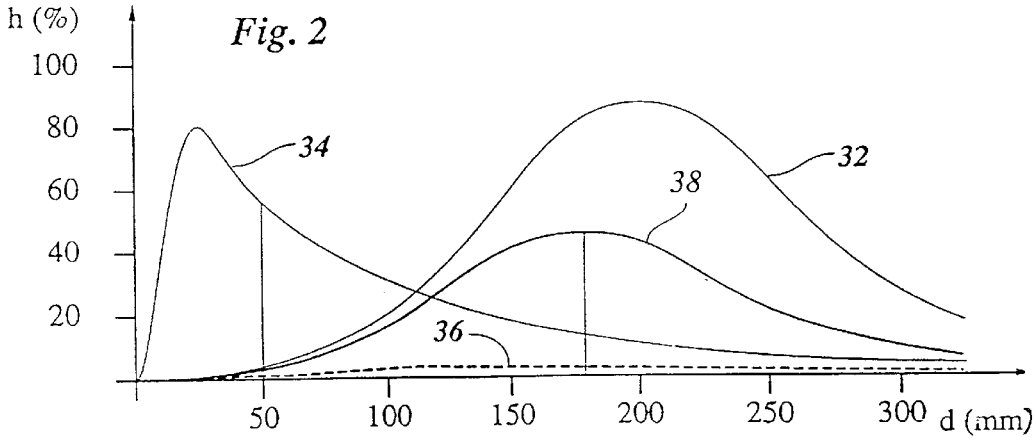
FIG. 2 is a diagram for explaining the effect of the structure shown in FIG. 1.

The curve 32 in FIG. 2 illustrates how the efficiency coefficient h for the transformation of acoustic energy into kinetic energy of the droplet depends on the depth d of the ink channel 16 in the vicinity of the nozzle 18. When the nozzle 18 has a size (height) of 30 μm, as in the example discussed above, this efficiency coefficient reaches its maximum near a depth d of 200 μm which corresponds to the depth of the portion 26 of the ink channel near the step 30.

The curve 34 in FIG. 2 indicates the relation between the depth d of the ink channel and the efficiency in the transformation of electric energy of the piezoelectric element 22 into acoustic energy. This efficiency substantially corresponds to the work done by the piezoelectric element 22 when a given voltage is applied thereto and a compressive force is exerted on the ink via the cover plate 20. Since this force occurs abruptly, the ink can be considered as a compressible solid medium which is reduced in volume until its own elastic force counterbalances the force of the piezoelectric element. The amount of displacement of the cover plate 20 can thus be calculated from an equilibrium condition for the elastic forces of the piezoelectric element 22 and the ink, and it is found that this displacement depends on the ratio between the elastic modulus of the ink and the piezoelectric material and on the ratio between the depth d of the ink channel and the height H of the piezoelectric element 22.

The work done to the ink liquid is calculated by integrating the force of the piezoelectric element over the displacement of the cover plate 20, and it can be shown that, for a given voltage applied to the piezoelectric element, this work becomes maximal when the ratio d/H between the depth of the ink channel and the height of the piezoelectric element 22 is equal to the ratio between the elastic modulus of the ink and the piezoelectric material. Since the elastic module of typical piezoelectric materials is much larger than that of typical ink liquids, in particular hot melt inks, and a height H of more than 500 μm for the piezoelectric element 22 is not practical, it is found that, taking energy dissipation into account, the optimal depth d of the ink channel would be in the order of 25 μm, as is indicated by the curve 34 in FIG. 2.

The total energy efficiency is the product of the efficiencies indicated by the curves 32 and 34. This product is represented by the curve 36 in FIG. 3. Since the peaks of the curves 32 and 34 are far apart from each other, the curve 36 has only a very shallow maximum around 100–150 μm. This means that, if the ink channel would have a constant depth on its entire length, the total energy efficiency is rather poor.

According to the invention, the depth of the portion 26 of the ink channel in the vicinity of the step 30 is increased, and the depth d of the portion 24 of the ink channel which is adjacent to the piezoelectric element 22 is made significantly smaller. Although it will not always be possible to set the depth d to its optimum value, because this would lead to an increased frictional resistance and increased reflections, it is possible to bring the depth d fairly close to the maximum of the curve 34.

In the example in FIG. 1, a depth of 50 μm has been selected, which gives still a comparatively large efficiency coefficient for the transformation of electric energy into acoustic energy. In this case, the corresponding total energy efficiency is represented by the curve 38 in FIG. 2. This curve resembles the curve 32, with the maximum being slightly shifted to smaller values. By comparing the respective maxima of the curves 36 and 38 it will be readily appreciated that the invention provides a remarkable gain in energy efficiency.

It should be noted that the example shown in FIG. 1 has only been given for illustrating the principle of the invention and that the details of the arrangement may be modified in various ways. For example, the abrupt step 30 may be replaced by a comparatively steep slope. On the other hand, the smooth slope 28 may be replaced by a staircase pattern or the like. In addition, the dimensions of the ink channel, the nozzle and the piezoelectric element 22 may be varied depending on the circumstances. When the length of the slope 28 is varied, this may be accompanied by a corresponding change of the total length of the ink channel 16 or may be compensated by a change in the length of the piezoelectric element 22.

When the length of the deepened part of the ink channel is reduced to a certain limit, another phenomenon comes into play. Then, the transition between the shallow portion 24 and the deepened portion 26 will not only cause an undesirable reflection of the high pressure wave propagating towards the nozzle 18 but also a desirable reflection of the high pressure wave which has been reflected at the step 30 in the initial phase. In this case, the deepened portion 26 of the ink channel behaves like a cavity in which acoustic energy can be trapped and accumulated.

Figure 3:
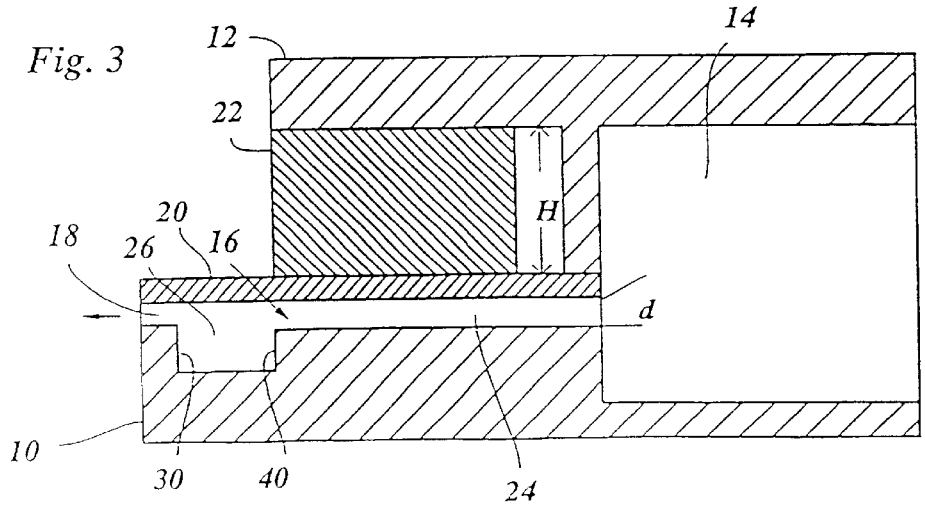
FIG. 3 is a schematic longitudinal cross-section of an ink-jet system of the present invention according to another embodiment.

This phenomenon is exploited in the embodiment shown in FIG. 3. Here, the length of the portion 26 of the ink channel 16 has been reduced to about 1 mm, and the slope 28 has been replaced by a steep step 40 The portion 26 has a constant depth of 200 μm. The length of the piezoelectric element is again 7 mm.

When a positive pressure wave is created by the piezoelectric element 22, the step 40 behaves like an open end which causes slight energy losses due to reflection at the step 40. On the other hand, the steps 30 and 40 define a cavity with closed ends in which a standing wave can be excited. The volume of the cavity and the viscosity of the ink define a certain time constant for the pressure rise upstream of the nozzle 18. Thus, by appropriately selecting the volume of the cavity, it is possible to match this time constant to the timing of the pulse applied to the piezoelectric element in order to optimize the dynamics of the nozzle and to achieve a pressure/time profile which is highly suitable for expelling an ink droplet with high energy.

In addition, during the suction stroke, the step 40 will behave like an open end of the upstream portion 24 of the ink channel, just like the open end on the side of the ink reservoir 14. The negative pressure wave created by the contraction of the piezoelectric element 22 will therefore be reflected at the step 40 with sign reversal, so that a positive pressure wave propagates back into the portion 24 of the ink channel. This reflected positive pressure wave contributes to a positive bias of the ink volume in the portion 24 at the beginning of the compression stroke, with the result that the work conferred to the ink in the compression stroke will also be increased. Thus, the provision of the step 40 also improves the efficiency represented by the curve 34 in FIG. 2.

While specific embodiments of the invention have been described above, it should be noted that the invention is not limited to these embodiments but includes various modifications which fall within the scope of the appended claims and will occur to a person skilled in the art having studied these claims. For example, while in the shown embodiments the upstream end of the slope 28 in FIG. 1 and the step 40 in FIG. 3 coincide with the downstream end of the piezoelectric element 22, this end of the piezoelectric element may also be offset from the upstream end of the slope 28 and the step 40, respectively. In addition, while the piezoelectric element 22 acts upon the ink in the portion 24 of the ink channel 16 through the elastic cover plate 20 in the shown embodiments, the upper wall of the portion 24 of the ink channel may be formed directly by the bottom surface of the piezoelectric element 22.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An ink-jet system comprising:

an ink channel between an ink reservoir and a nozzle, the ink channel being attached to the ink reservoir and the nozzle; and an electromechanical transducer which comprises an expansible member being arranged adjacent and operatively connected to the ink channel for abruptly reducing volume of the ink channel to thereby eject an ink droplet through said nozzle, the ink channel having a first portion and a second portion with each portion having a depth as measured in a depth direction, the expansible member exerts a force on ink in the ink channel in the depth direction, the second portion of the ink channel being between the expansible member and the nozzle and the first portion of the ink channel being adjacent to the expansible member, the depth of the second portion being larger than the depth of the first portion and being larger than a height of the nozzle.

2. The ink-jet system according to claim 1, wherein:

the expansible member and ink have elastic modulus and the ink has a viscosity;

the depth of the first portion of the ink channel adjacent to the expansible member is selected in accordance with the respective elastic modulus of the expansible member and of the ink and with the viscosity of the ink so as to optimize efficiency with which an acoustic pressure wave in the ink is generated by the expansible member; and the depth of the second portion of the ink channel directly adjacent to the nozzle is selected in accordance with dimensions of the nozzle to optimize the efficiency with which energy of the acoustic wave is transformed into kinetic energy of the ink droplet. efficiency with which the energy of the acoustic wave is transformed into kinetic energy of the ink droplet.

3. The ink-jet system according to claim 2, wherein the expansible member of the transducer is a piezoelectric element.

4. The ink-jet system according to claim 3, wherein said ink channel is formed by a shaped groove in a substrate which is covered by an elastic cover plate, said piezoelectric element being adjacent to said cover plate.

5. The ink-jet system according to claim 1, wherein a bottom surface of the second portion of the ink channel between the expansible member and the nozzle is formed by a smooth slope.

6. The ink-jet system according to claim 1, wherein the second portion of the ink channel between the expansible member and the nozzle is shaped as a cavity.

7. The ink-jet system according to claim 1, wherein the expansible member of the transducer is a piezoelectric element.

8. The ink-jet system according to claim 1, wherein said ink channel is formed by a shaped groove in a substrate which is covered by an elastic cover plate, said expansible member being adjacent to said cover plate.

9. The ink-jet system according to claim 1, wherein the depth of the second portion of the ink channel between the expansible member and the nozzle is more than three times the depth of the first portion of the ink channel adjacent to the expansible member.

10. The ink-jet system according to claim 1, wherein the depth of the second portion of the ink channel between the expansible member and the nozzle gradually increases from said expansible member towards the nozzle.

11. The ink-jet system according to claim 10, wherein a bottom surface of the second portion of the ink channel between the expansible member and the nozzle is formed by a smooth slope.

12. The ink-jet system according to claim 1, wherein the second portion of the ink channel between the expansible member and the nozzle is shaped as a cavity.

13. The ink-jet system according to claim 1, wherein the ink channel has a longitudinal axis and wherein opposed ends of said second portion are perpendicular to the longitudinal axis of the ink channel.

14. The ink-jet system according to claim 1, wherein the depth of the second portion of the ink channel between the expansible member and the nozzle is constant.

15. The ink-jet system according to claim 1, wherein opposed ends of the second portion are formed by steep steps.

16. The ink-jet system according to claim 1, wherein the second portion has an upstream end and a downstream end, the downstream end being closer to the nozzle than the upstream end and wherein the ink channel has a longitudinal axis with a face of the second portion at the downstream end being perpendicular to the longitudinal axis.

17. The ink-jet system according to claim 16, wherein the upstream end of the second portion has a face which is perpendicular to the longitudinal axis of the ink channel.

18. The ink-jet system according to claim 16, wherein the bottom surface of the second portion extends to the upstream end of the second portion, the bottom surface of the second portion being non-perpendicular to the longitudinal axis of the ink channel such that the second portion of the ink channel has a slope which is inclined relative to the longitudinal axis.

19. The ink-jet system according to claim 18, wherein the slope of the bottom surface of the second portion is smooth.

20. The ink-jet system according to claim 1, wherein the depth of the first portion of the ink channel is uniform.

21. The ink-jet system according to claim 1, wherein a deepest part of the second portion of the ink channel is spaced from the transducer.

22. The ink-jet system according to claim 1, wherein the ink channel from adjacent the transducer to the nozzle extends in a direction perpendicular to the depth direction.

* * * * *

UNITED STATES PATENT AND TRADEMARK OFFICE

CERTIFICATE OF CORRECTION

PATENT NO. : 6,447,105 B1
DATED : September 10, 2002
INVENTOR(S) : Ron Linnewiel It is certified that error appears in the above-identified patent and that said Letters Patent is hereby corrected as shown below:

Column 6,
Lines 9-57,

Please cancel claims 2-10 as published and substitute therefor the following claims 2-10:

2. The tamper-evident tape or label of claim 1, in which said base layer is made of translucent plastic material.

3. The tamper evident tape or label of claim 1, in which said adhesive is made of rubber based glue or rubber based self adhesive.

4. The tamper-evident tape or label of claim 1, in which said release liner is made of siliconized paper or plastic film.

5. The tamper evident tape or label of claim 1, in which said covering is locally connected to the upper side base layer through the use of welding distributed in several locations along the tape.

6. The tamper evident tape or label of claim 1, in which said covering is locally connected to the upper side of said base layer through the use of welding distributed longitudinally and laterally in several locations along the tape.

7. The tamper-evident tape or label of claim 1, in which the opposing bottom face of base layer is made of low density cast polymer.

8. The tamper-evident tape or label of claim 1, in which said base layer is made of low density blown polymer.

9. The tamper-evident tape or label of claim 7, in which said base layer is made of polyethylene and said covering layer is made of polypropylene or polyethylene or PVC.

10. The tamper-evident tape or label of claim 7, in which said base layer is made of bi-oriented or mono-oriented polymer.

Signed and Sealed this

Second Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,447,105 B1
DATED : September 10, 2002
INVENTOR(S) : Hans Reinten

It is certified that error appears in the above-identified patent and that said Letters Patent is hereby corrected as shown below:

This certificate supersedes Certificate of Correction issued September 2, 2003, the number was erroneously mentioned and should be vacated since no Certificate of Correction was granted.

Signed and Sealed this

Twenty-first Day of October, 2003

JAMES E. ROGAN
*Director of the United States Patent and Trademark Office*